US011744410B2

(12) United States Patent
Kothe/Rice

(10) Patent No.: US 11,744,410 B2
(45) Date of Patent: Sep. 5, 2023

(54) WALK IN TUB SHOWER CURTAIN

(71) Applicant: Pennie Jo Kothe/Rice, Denver, CO (US)

(72) Inventor: Pennie Jo Kothe/Rice, Denver, CO (US)

( * ) Notice: Subject to any disclaimer, the term of this patent is extended or adjusted under 35 U.S.C. 154(b) by 0 days.

(21) Appl. No.: 17/457,054

(22) Filed: Jan. 11, 2022

(65) Prior Publication Data

US 2023/0218122 A1 Jul. 13, 2023

(51) Int. Cl.
*A47K 3/38* (2006.01)

(52) U.S. Cl.
CPC ..... *A47K 3/38* (2013.01)

(58) Field of Classification Search
CPC ..... A47K 3/38
See application file for complete search history.

(56) References Cited

U.S. PATENT DOCUMENTS

| | | | | |
|---|---|---|---|---|
| 6,336,232 | B1 * | 1/2002 | Toder | A47K 3/38 4/558 |
| 7,761,935 | B1 * | 7/2010 | Whitaker | A47K 3/38 4/558 |
| D655,552 | S * | 3/2012 | Beyda | D6/575 |
| 2010/0288453 | A1 * | 11/2010 | Richardson | A47K 3/38 160/349.1 |
| 2012/0298117 | A1 * | 11/2012 | Giles | A61F 7/0097 128/853 |

* cited by examiner

*Primary Examiner* — Jeremy Carroll

(57) ABSTRACT

A shower curtain (100) is disclosed for a walk-in tub (102). The walk-in tub (102) includes a door (104) extending through the tub wall so that an individual can enter and exit the tub (102) through the door (104), thus avoiding the need to step over a top edge of the tub (102). The shower curtain (100) has a first shower curtain section and a second shower curtain section. The first section is configured to extend around a periphery of the tub (102) and has a height extending between a curtain rod (106) and said top edge of said tub (102). The second section extends downwardly from said bottom end of said first shower curtain section such that the first and second shower curtain sections define a "T" shape. The second shower curtain section can be positioned at the door (104) of said tub (102) during use to provide protection against water spilling out on the floor.

1 Claim, 3 Drawing Sheets

WALK IN TUB SHOWER CURTAIN

FIELD OF THE INVENTION

The present invention relates generally to shower curtains and, in particular, to a shower curtain with a different design to fit walk-in tubs. The shower curtain is made via a process similar to that of conventional shower curtains but with the "T" cutting, with a better fit on the tub to prevent water leaking out, The curtain can be made of the same plasticor fabric that conventional shower curtains are made of.

BACKGROUND OF THE INVENTION

In modern society, people are increasingly using walk-in bathtubs. These tubs include a door through the tub wall so that it is not necessary for the user to lift his or her legs over the top edge of the tub. However, shower curtains are generally made for conventional tubs. There is a need for shower curtains for walk-in tubs.

SUMMARY OF THE INVENTION

The present invention is directed to walk-in tub shower curtain with a "T" shape. The T-shape better fits the walk-in tub so that the curtain can cover the tub door. A further object of the invention is to aid the bather in having a nicer bathing experience. The curtain helps in this regard by not allowing as much water to spill out on to the floor. Furthermore, some walk-in tubs are heated. The invention helps to keep the heat inside of the shower area. It still provides the same advantages as your regular shower curtain but with a better fitting for the tub to close the gaps that regular curtains leave when used in a walk-in tub.

DETAILED DESCRIPTION OF THE INVENTION

Figure 1:
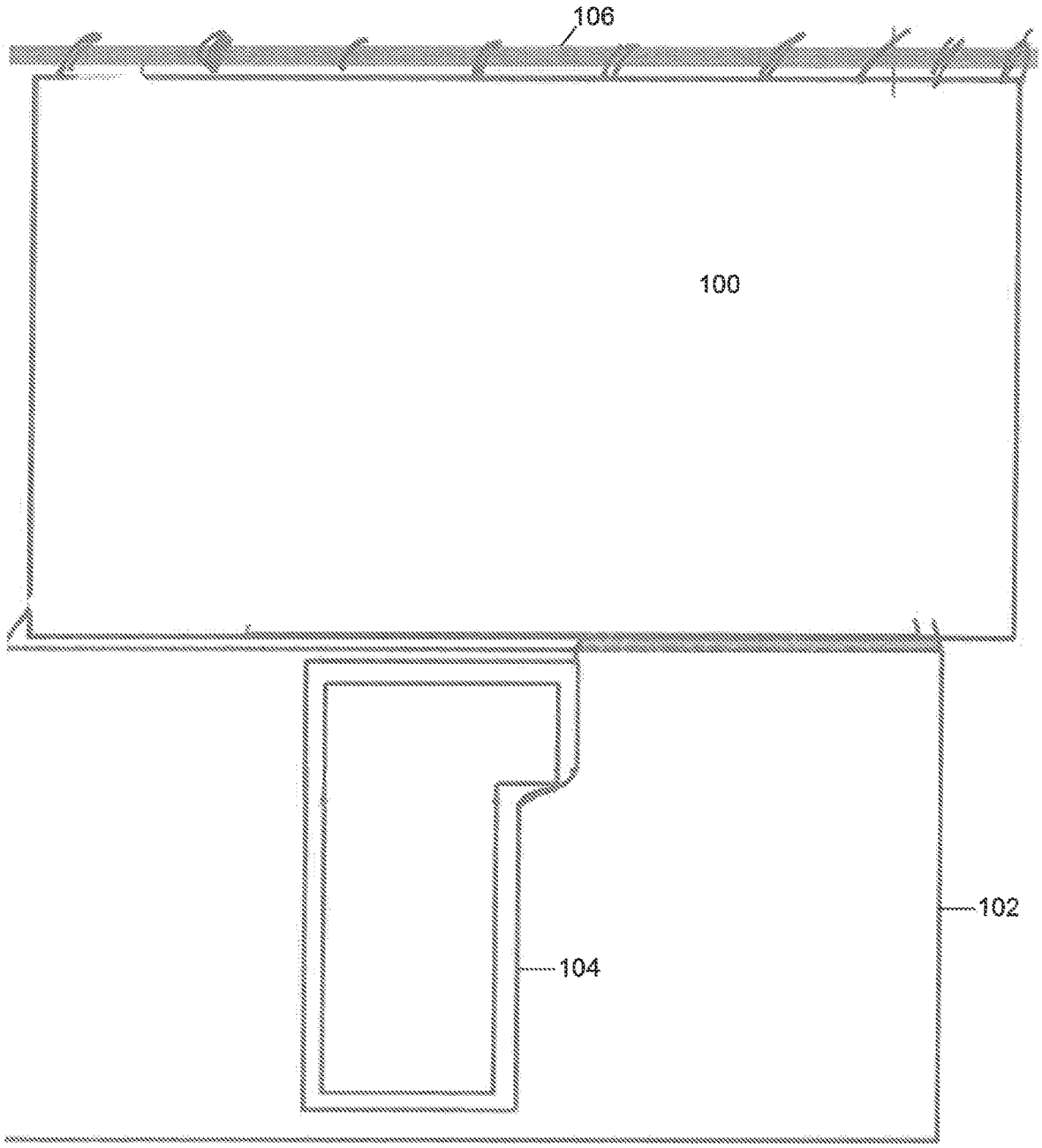
FIG. 1 shows a side view of a shower curtain used on a walk-in tub in accordance with the present invention.
Figure 2:
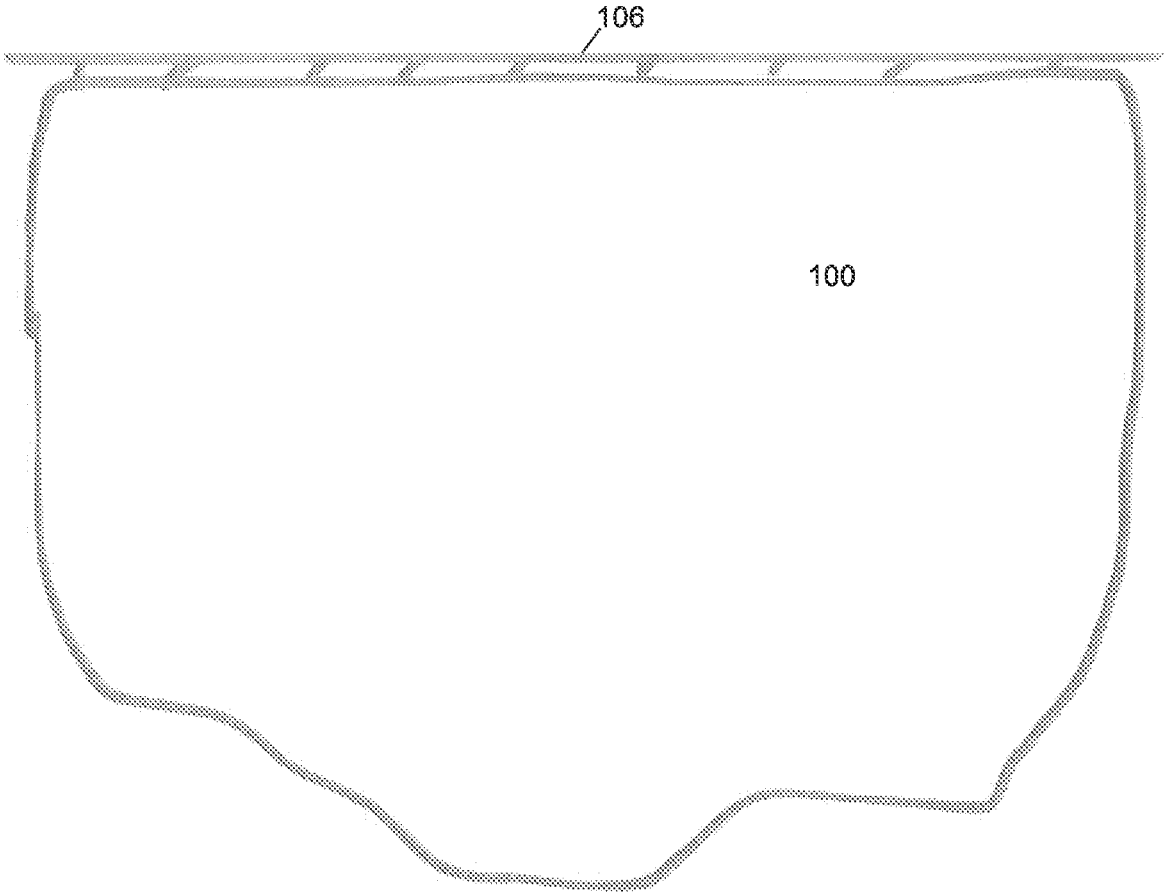
FIG. 2 is an inside, cut-away view of the curtain of FIG. 1.
Figure 3:
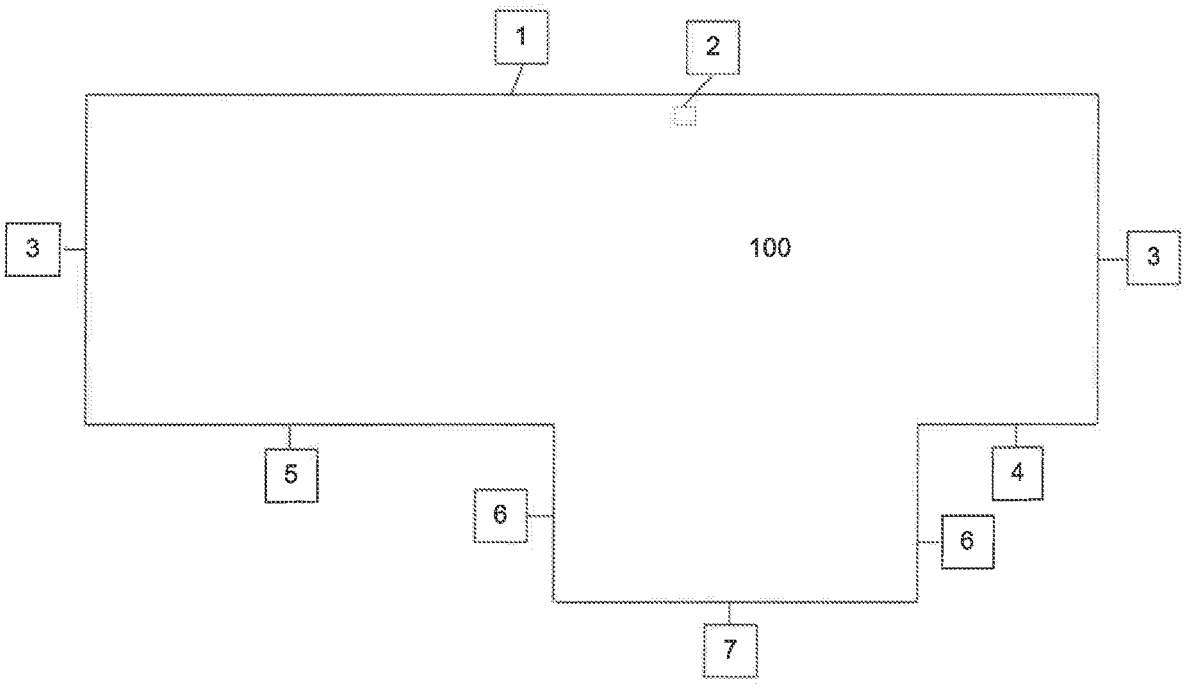
FIG. 3 is a side view of the curtain of FIG. 1 showing various measurements.

FIGS. 1-3 show a shower curtain 100, in accordance with the present invention, designed to fit a walk-in tub 102. The curtain 100 can be made by the same process as regular shower curtains but with the "T" cutting shape. It is made of the same plastic or fabric that conventional shower curtains are made of.

FIG. 1 shows a side view of the walk-in bathtub shower curtain 100. It is a tighter fitting shower curtain for a walk-in tub 102 that has a door 104. It also shows how it is attached to the curtain rod 106 outside of the tub 102.

FIG. 2 shows how it looks from the inside of the tub 102. The curtain 100 holds close to the walls of the tub 102.

FIG. 3 is in more detail as follows:

a. The top edge 1 of the curtain 100 may be the same as conventional shower curtains, 80 inches with holes 2 for 14 metal grommets for rings to attach to the curtain rod 106.

b. 14 holes 2, are provided with medal grommets to attach the curtain 102 to the curtain rod 106.

c. The sides 3 of the curtain 102 are 35 inches long.

d. The back side 4 is 10 inches before getting to the center section 6.

e. The front side 5 is 25 inches before getting to the center section 6.

f. The center section 6 is 45 inches long.

g. The bottom end 7 of the center section is 45 inches wide.

The invention claimed is:

1. A shower curtain fora walk-in tub, the walk-in tub including a door extending through the tub wall so that an individual can enter and exit the tub through the door, thus avoiding the need to step over a top edge of the tub; said shower curtain assembly comprising:

a first shower curtain section configured to extend around a portion of a periphery of said tub, said first shower curtain section having a height extending between a curtain rod and said top edge of said tub, said first shower curtain section having a top end portion with openings for receiving rings to attach the shower curtain to said curtain rod and a bottom end opposite said top end portion; and a second shower curtain section, extending downwardly from said bottom end of said first shower curtain section such that said first and second shower curtain sections define a "T" shape;

wherein said second shower curtain section can be positioned at said door of said tub during use.

* * * * *